US009745885B2

(12) United States Patent
Geminn et al.

(10) Patent No.: US 9,745,885 B2
(45) Date of Patent: Aug. 29, 2017

(54) MODULAR MANIFOLD FOR MOTOR VEHICLES

(75) Inventors: Markus Geminn, St. Martin (DE); Andreas Steigert, Lambrecht (DE); Margit Roth, Freimersheim (DE)

(73) Assignee: TENNECO GMBH, Edenkoben (DE)

( * ) Notice: Subject to any disclaimer, the term of this patent is extended or adjusted under 35 U.S.C. 154(b) by 219 days.

(21) Appl. No.: 14/127,537

(22) PCT Filed: Jun. 26, 2012

(86) PCT No.: PCT/EP2012/062370

§ 371 (c)(1),
(2), (4) Date: Dec. 19, 2013

(87) PCT Pub. No.: WO2013/000919

PCT Pub. Date: Jan. 3, 2013

(65) Prior Publication Data

US 2014/0165544 A1 Jun. 19, 2014

(30) Foreign Application Priority Data

Jun. 27, 2011 (DE) ..... 10 2011 106 242

(51) Int. Cl.
*F01N 1/00* (2006.01)
*F01N 13/10* (2010.01)
(Continued)

(52) U.S. Cl.
CPC ..... *F01N 13/10* (2013.01); *F01N 13/102* (2013.01); *F01N 13/141* (2013.01);
(Continued)

(58) Field of Classification Search
CPC ..... F01N 13/10; F01N 13/102; F01N 13/141; F01N 13/1805; F01N 13/1888; F01N 13/1816; Y10T 29/49398
(Continued)

(56) References Cited

U.S. PATENT DOCUMENTS

| | | | | |
|---|---|---|---|---|
| 2,423,574 | A * | 7/1947 | Barrett | 60/321 |
| 4,288,988 | A | 9/1981 | Curtil | |
| 2005/0183414 | A1* | 8/2005 | Bien et al. | 60/323 |

FOREIGN PATENT DOCUMENTS

| | | | |
|---|---|---|---|
| DE | G 94 17 314.1 | U1 | 2/1995 |
| DE | 43 39 290 | A1 | 5/1995 |

(Continued)

*Primary Examiner* — Jason Shanske
*Assistant Examiner* — Kelsey Stanek
(74) *Attorney, Agent, or Firm* — Hudak, Shunk & Farine Co. LPA

(57) ABSTRACT

A modular exhaust manifold 1 for a motor vehicle, with multiple adjoining manifold pipe modules, having: at least one engine flange, via which an inlet connection pipe of the manifold pipe modules can be connected to a cylinder head of the motor vehicle; at least one manifold pipe module, configured as a collector pipe module and having a contact flange, via which the exhaust manifold can be connected to an exhaust system of the motor vehicle, the respective manifold pipe modules having an overlap contour of a length a that permits the telescoping of two manifold pipe modules to an insertion depth t for coupling purposes, at least two manifold pipe modules being identical in shape, and a variation of the insertion depth t of at least 5 mm to 30 mm or 10 mm or 15 mm or 20 mm or 25 mm being obtained by the formation of length a of the overlap contour. A method for producing a manifold formed from multiple adjoining manifold pipe modules.

19 Claims, 3 Drawing Sheets

(51) Int. Cl.
*F01N 13/14* (2010.01)
*F01N 13/18* (2010.01)

(52) U.S. Cl.
CPC ..... *F01N 13/1805* (2013.01); *F01N 13/1888* (2013.01); *F01N 13/1816* (2013.01); *Y10T 29/49398* (2015.01)

(58) Field of Classification Search
USPC ..... 60/272–324, 598; 29/890.08, 890.148; 422/179, 177, 180
See application file for complete search history.

(56) References Cited

FOREIGN PATENT DOCUMENTS

| | | | | |
|---|---|---|---|---|
| DE | 196 44 707 | A1 | | 4/1998 |
| DE | 199 23 557 | A1 | | 11/2000 |
| DE | 19923557 | A1 | * | 11/2000 |
| DE | 199 09 934 | C1 | | 1/2001 |
| DE | 101 49 381 | A1 | | 5/2003 |
| DE | 103 01 395 | A1 | | 7/2004 |
| DE | 103 28 027 | A1 | | 1/2005 |
| JP | 9 296725 | A | | 11/1997 |
| WO | 79 00623 | A1 | | 9/1979 |

* cited by examiner

MODULAR MANIFOLD FOR MOTOR VEHICLES

FIELD OF THE INVENTION

The invention relates to a modular exhaust manifold of a motor vehicle with multiple adjoining single-wall manifold pipe modules, with at least one engine flange, via which multiple inlet connecting pieces of the manifold pipe modules can be connected to a cylinder head of the motor vehicle, wherein at least one manifold pipe module configured as a collector pipe module and having a contact flange is provided, via which manifold pipe module the exhaust manifold can be connected to an exhaust system of the motor vehicle, wherein the respective manifold pipe module has an overlapping contour of a length a that ensures the telescoping of two manifold pipe modules at a time to an insertion depth t for the purpose of coupling, wherein at least two manifold pipe modules are identical in shape.

The invention further relates to a method for producing a manifold formed from multiple adjoining manifold pipe modules, each of them having at least one joining surface and one inlet connecting piece, wherein, according to the method, the respective manifold pipe module configured as a hinged shell is closed and so connected as to be gas-tight in the region of the joining surface and the engine flange is welded onto the inlet connecting piece.

BACKGROUND OF THE INVENTION

A cast-part modular exhaust manifold whose various modules are at least partially identical in shape is already known from U.S. Pat. No. 4,288,988 A. If one wants to ensure sufficiently high process reliability, the walls of cast parts will have to be relatively thick.

A branch socket of an exhaust manifold configured as a hinged shell is known from DE 101 49 381 A1. The sheet metal section is cut and then deep-drawn and trimmed. This is followed by a forming process so that the joining flanges can be welded in a final step. Therefore, multiple branch sockets would be produced as a one-piece component with an increased number of bulges in the deep-drawing process.

A two-shell modular exhaust manifold whose internal-pipe modules are configured as hydroformed parts is known from DE 103 28 027 A1. The modules can be connected to each other by means of close sliding fits or plug-type connectors (already known from DE 43 39 290 C2) and are welded to each other via the outer shell. The internal pipes and the outer shells can be easily connected by means of the close sliding fits. Concerning the outer shell, the close sliding fits ensure the compensation for production-related tolerances prior to welding so that a weldable cover of the outer shell is provided in any case. The various modules may be provided as elements of a modular system. The manifold formed in this way tapers starting from the first arc module, i.e., the cross-section of the pipe increases continuously. Therefore, however, modules having different shapes, i.e., not being identical in shape, are required for designing a manifold.

A two-shell modular exhaust manifold whose internal-pipe modules are configured as hydroformed parts is also known from DE 199 23 557 A1. Furthermore, the use of identical components for the internal manifold pipes is described, said parts making the production of a six-cylinder or eight-cylinder exhaust manifold from a four-cylinder exhaust manifold possible.

JP 9 296 725 A describes a cast-part modular exhaust manifold, wherein the manifold pipe modules to be connected have an overlapping contour configured for telescoping. Said overlapping contour or the additional use of a sliding element makes relative motions between the manifold pipe modules on account of thermal stress or thermal expansion possible. For this purpose, appropriate meander-shaped compensating sleeves or bellows sleeves are provided in the region of the aforementioned overlapping contour, said sleeves ensuring tightness between two interconnected modules on the one hand and compensation between the manifold pipe modules connected thereto on the other hand.

SUMMARY OF THE INVENTION

The object of the invention is to configure and arrange a modular exhaust manifold in such a manner that a simple and cost-effective design is ensured.

According to the invention, said object is achieved due to the facts that the manifold pipe module is made of sheet metal and has only one inlet connecting piece at a time and that the formation of the length a of the overlapping contour allows a variation of the insertion depth t by at least 5 mm to 15 mm or by at least 5 mm to 100 mm or by at least another integral value of the ninety-six values between 4 mm and 101 mm, wherein the insertion depth t is fixed by welding the manifold pipe module to the manifold pipe module inserted therein, wherein it may be advantageous if the length a exceeds the desired variation of the insertion depth t by at least 2 mm, i.e., if it is at least 7 mm to 102 mm or has another integral value of the ninety-six values between 6 mm and 103 mm, whereby the distances between the manifold pipe modules can be varied to a sufficient extent and the manifold pipe modules can thus be used to construct manifolds that vary in geometry, particularly out of consideration for the varying distances between the cylinder outlets of different cylinder heads. The inventive dimension ensures a minimum covering of 2 mm that, on the one hand, allows the telescoped overlapping contours to be connected (e.g., by welding or soldering) and, on the other hand, is large enough to allow thermally caused relative motions between the telescoped internal pipes, the latter being allowed because the length of the internal pipes only increases starting from the cold mounting state and the covering consequently increases.

Moreover, the respective overlapping contour can be adjusted to the desired installation space conditions by shortening thereof so that the insertion depth t or the covering of the overlapping contours can be reduced to the suitable and desired dimension, particularly against the background of the production of only one or few shapes of the manifold pipe module with large lengths a for all conceivable cylinder heads.

The close sliding fits or plug-type connectors known from DE 103 28 027 A1 or DE 199 23 557 A1 mentioned above that make a change in length possible in principle are insufficient because they only make a compensation for the thermally caused relative motions between the internal pipes or for the production-related tolerances possible. Any additional variation of the distances out of consideration for different cylinder head geometries will not be allowed by the exhaust manifold described herein if only because the pipe sections are conical in the region of the plug-type connector.

Advantageously, each manifold pipe module may be provided with a separate outer shell module and be a double-walled air-gap-insulated module. Thus, the manifold pipe module configured as a hinged shell does not have to be tight any more so that the joining process for said module can be reduced to the minimum. It is, however, absolutely necessary that the outer shell module or the outer shell formed in this way is tight.

Said object is also achieved due to the facts that the manifold pipe module is made of sheet metal, wherein each manifold pipe module is provided with an outer shell module and is a double-walled air-gap-insulated module, wherein there is only one inlet connecting piece per module, and that the formation of the length a of the overlapping contour makes a variation of the insertion depth t of at least 5 mm to 100 mm possible, wherein the insertion depth t is fixed by welding the outer shell module to the outer shell module inserted therein.

It may be particularly important for the present invention if the outer shell module is configured as a hinged shell, wherein in the region of the inlet connecting piece, the outer shell module is so connected to the engine flange as to be gas-tight and the manifold pipe module is so connected to the outer shell module and/or to the engine flange as to be gas-tight. The outer shell module has to be root-penetration-welded in the region of the inlet connecting piece in order to ensure tightness also in the region of the engine flange.

Concerning this, an advantage may also consist in shaping all manifold pipe modules identically, with no more than two exceptions regarding the collector pipe module and/or the first manifold pipe module, so that only one manifold pipe module shape that can be used to form any manifold needs to be produced at best. If this is not desired (e.g., for installation space reasons), it will be necessary to provide one further shape for the collector pipe module and/or one further shape for the first manifold pipe module in the row in addition to that one shape mentioned above.

It may also be advantageous if the manifold pipe module is configured as a hinged shell with two joining surfaces that can be placed against each other, wherein the joining surface is root-penetration-welded in the region of the inlet connecting piece. The hinged shell has two advantages. On the one hand, the production thereof is cheaper than that of a hydroformed part. On the other hand, uniform wall thicknesses can be reproduced, which cannot always be ensured with T-shaped hydroformed parts.

In connection with the inventive configuration and arrangement, a manifold pipe module in the form of a hydroformed part or in the form of a two-shell manifold pipe module made up of two separate shells as an alternative to the hinged-shell design may be advantageous, particularly with larger piece numbers where specific tooling costs are lower.

It may be advantageous in principle if the manifold pipe module has an overlapping contour in the form of a taper and the outer shell module of the manifold pipe module to be connected has an overlapping contour in the form of an expanded portion in this connecting zone. Thus, the gap between the manifold pipe module and the outer shell module formed in the connecting zone is not narrowed or at least insignificantly narrowed. The overlapping areas or zones having changed diameters, i.e., the taper of the manifold pipe module and the expanded portion of the outer shell module, provide sufficient space for doubling the wall thicknesses of the two overlapping zones. The overlapping contour of the manifold pipe module serves as a guide between the manifold pipe modules to be telescoped that are not accessible any more on account of the outer shell modules that have to be telescoped as well.

It may also be advantageous if a sealing element is provided, by means of which the first manifold pipe module or the outer shell module is sealed at the free end. The free end of the first module in the row has to be sealed because the manifold pipe modules are identical components. The free end of the last manifold pipe module or of the collector pipe module has the contact flange for connecting an exhaust system so that it does not have to be sealed.

It may also be advantageous if the manifold pipe modules have seals, such as graphite rings, in the region of the overlapping contour. The seals or sealing rings may be provided on the overlapping contour that has to be slipped on and/or on the overlapping contour that has to be inserted. The connection between the telescoped manifold pipe modules is sealed by means of the seals or sealing rings. Additionally or alternatively, corresponding seals may also be provided for the respective outer shell module. The sealing ring is installed between the two modules to be connected, wherein it is installed in such a manner that it is radially pressed between the inner shell and the outer shell to a sufficiently high extent so that the close sliding fit formed in this way is gas-tight. For this purpose, the sealing ring is fixed, having positive and/or non-positive fit, either on the inner shell and/or on the outer shell in an axial direction by means of a holding geometry so that the axial alignment of the sealing ring is fixed at least with respect to the inner shell or the outer shell.

It may also be advantageous if the manifold pipe modules are coupled by means of an expansion component. Said expansion component may be, e.g., a folding pipe or a folding-pipe section or a bellow expansion joint connected to both manifold pipe modules to be connected. For forming this connection, one may also use an overlapping contour that allows a sufficiently wide variation of the distances between adjacent manifold pipe modules or manifold pipe modules to be connected. Alternatively, for the two-shell solution, corresponding expansion components may also be provided for the respective outer shell module. The expansion component can also be used as an adapter for accommodating the respective front side to be connected. For this purpose, the expansion component has an appropriate overlapping contour.

Concerning this, it may be advantageous if the exhaust manifold is configured for heavy-duty applications according to any one of the preceding claims.

According to the inventive method, it may be advantageous if several such manifold pipe modules are telescoped, by means of the overlapping contour, in the number of the exhaust channels of the cylinder head to be connected, the insertion depth t is adjusted, when telescoping, to the respective architecture of a cylinder head and to the distances between the exhaust channels of the cylinder head to be connected that result from said architecture, and two manifold pipe modules at a time are so connected by welding as to be gas-tight, wherein they are connected directly.

Concerning this, it may also be advantageous according to the inventive method for producing two-shell manifolds if the closed manifold pipe module is put into an outer shell module configured as a hinged shell, the outer shell module is closed in the region of the joining surface and so closed there by form closure or by firmly bonding as to be gas-tight, the engine flange is welded onto the inlet connecting piece, several such submodules consisting of an outer shell module and an integrated manifold pipe module are telescoped, by means of the respective overlapping contour, in the number of the exhaust channels of the cylinder head to be connected, the insertion depth t is adjusted, when telescoping, to the respective architecture of a cylinder head and to the distances between the exhaust channels of the cylinder head to be connected that result from said architecture, and two submodules at a time are so connected to each other, by welding the outer shell modules, as to be gas-tight, wherein they are connected directly.

Coupling may be performed by means of form closure or by firmly bonding or by using a sealing ring that is located between the inner shell and the outer shell and sealingly contacts the inner shell and the outer shell in a radial direction.

It may also be advantageous if the inlet connecting piece is shortened, by cutting off, prior to being connected to the engine flange, said shortening being performed according to the present installation space conditions. Thus, the module can be adjusted to the installation space conditions with respect to the distance from the cylinder head as well.

It may also be advantageous if the outer shell module is so connected to the engine flange as to be gas-tight and the manifold pipe module is so connected to the outer shell module and/or to the engine flange as to be gas-tight. Advantageously, both modules are connected to the flange in one operation, wherein three components can be handled with one weld seam in this case.

It is also possible to connect the inner shell to the outer shell and to connect the outer shell to the flange afterwards.

It may be advantageous if a guide for the manifold pipe module is provided when the outer shell module is connected to the outlet flange. Guiding the manifold pipe modules relative to each other by means of the overlapping contours ensures the correct distance between the outer shell module and the manifold pipe module.

It may also be advantageous if the first manifold pipe module and/or the outer shell module are/is sealed, by means of a sealing element, in the region of the overlapping contour that is still free or open. Thus, a modular manifold can be produced from identical components in a simple and cost-effective manner without using a separate end pipe piece. The sealing elements to be used are always identical for single-shell or two-shell manifolds as well and serve to seal the inner shell or the outer shell on the front side thereof.

BRIEF DESCRIPTION OF THE INVENTION

Further advantages and details of the invention are explained in the patent claims and in the description and illustrated in the figures in which FIG. 1*a* shows a sectional view of a modular exhaust manifold;

FIG. 1*b* shows a perspective side view according to FIG. 1*a;*

Figure 7A:
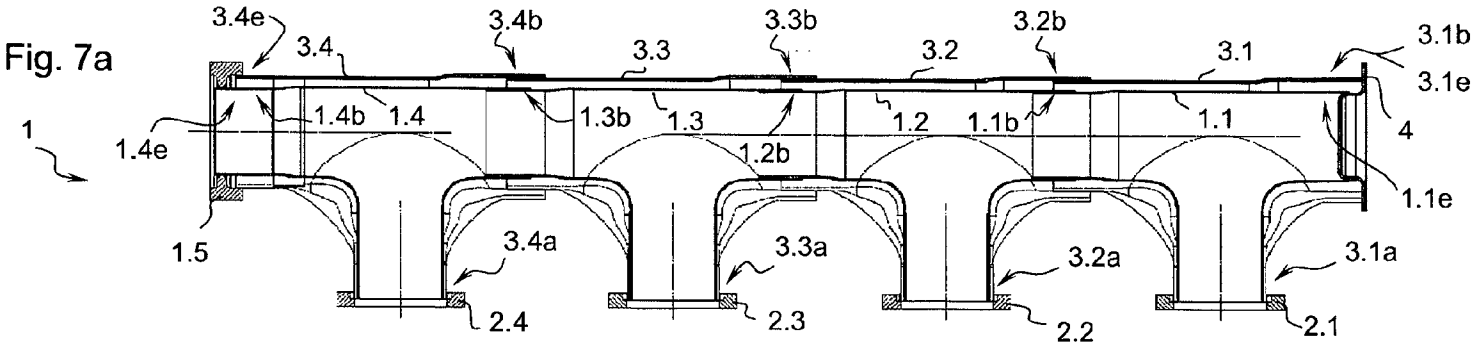
Figure 7B:
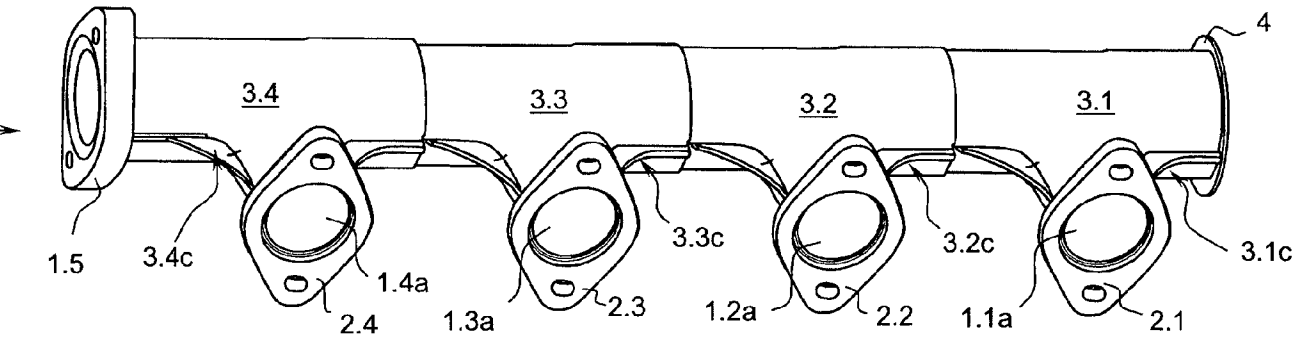

FIG. 7*a* shows a sectional view of a modular two-shell manifold;

FIG. 7*b* shows a perspective side view according to FIG. 7*a*.

DETAILED DESCRIPTION OF THE INVENTION

Figure 1A:
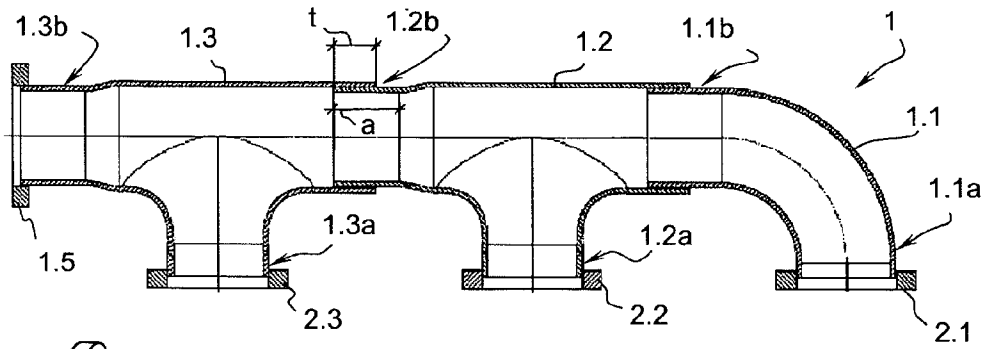

An exhaust manifold 1 according to FIG. 1*a* has three manifold pipe modules 1.1 to 1.3. The respective manifold pipe module has an inlet connecting piece 1.1*a* to 1.3*a*, to which one engine flange 2.1 to 2.3 at a time is attached. The first manifold pipe module 1.1 is arc-shaped, whereas the two manifold pipe modules 1.2 and 1.3 are identical in shape. The manifold pipe modules 1.2, 1.3 are basically T-shaped and are telescoped to an insertion depth t by means of an overlapping contour 1.1*b*, 1.2*b* of a length a. An overlapping contour 1.3*b* of the third manifold pipe module 1.3 serves to accommodate a contact flange 1.5 for connecting to an exhaust system that is not shown in further detail. The aforementioned engine flanges 2.1 to 2.3 serve to connect to a cylinder head (not shown) or to cylinder outlets (not shown).

The first manifold pipe module 1.1 is arc-shaped and has, in contrast to the second and third manifold pipe modules 1.2, 1.3, an overlapping contour 1.1*b* with a diameter that is not tapered in comparison with the other portion of the pipe bend. In principle, a taper of the overlapping contour 1.1*b* is conceivable as well. In contrast thereto, an overlapping contour between the illustrated manifold pipe modules 1.1 to 1.3 could also be realized by expanding the diameter instead of reducing it. The expanded portion is slipped on the adjacent manifold pipe module to an appropriate insertion depth.

The respective manifold pipe module 1.1 to 1.3 is configured as a hinged part that is kept and connected in the illustrated pipe shape by means of appropriate joining surfaces 1.2*c*, 1.3*c*. The arc-shaped first manifold pipe module 1.1 is not configured as a hinged part because the simple arc shape of the pipe is a simple standard geometry. The diameters of the respective inlet connecting pieces 1.1*a* to 1.3*a* are not tapered, either. This is because the respective engine flange 2.1 to 2.3 has an appropriately large inner diameter.

By means of the overlapping contour 1.1*b*, 1.2*b*, the configuration of the manifold pipe modules 1.1 to 1.3 can be varied with respect to the distances between the inlet connecting pieces 1.1*a* to 1.3*a* or between the engine flanges 2.1 to 2.3. By varying the insertion depth t, the distances between the aforementioned engine flanges 2.1 to 2.3 can be varied within the range of the realizable insertion depth and can be adjusted to different engine or cylinder head geometries to this extent. The length a of the overlapping contour is approximately 15 mm so that the insertion depth t cannot be more than 15 mm in principle or can be reduced to a minimum dimension of 2 mm if larger distances are used so that the distance between two engine flanges can be varied by exactly 13 mm.

Figure 1B:
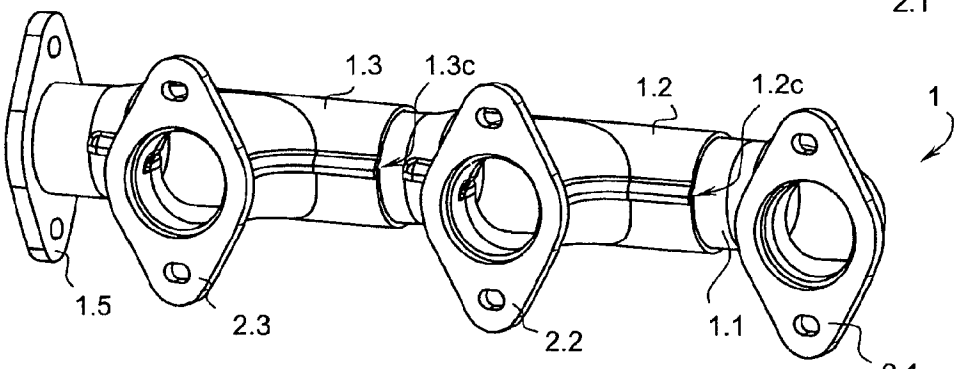
Figure 2:
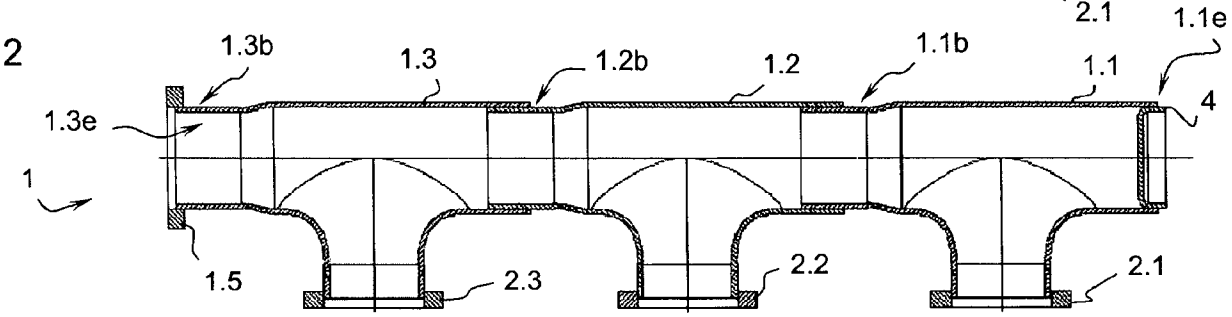
FIG. 2 shows a sectional view of a further embodiment.

According to the exemplary embodiment of FIG. 2, all three manifold pipe modules 1.1 to 1.3 are identical in shape. The second manifold pipe module 1.2 is slipped on the overlapping contour 1.1*b* of the first manifold pipe module 1.1, whereas the third manifold pipe module 1.3 is slipped on the overlapping contour 1.2*b* of the second manifold pipe module 1.2. The open end 1.1*e* of the first manifold pipe module 1.1 is sealed by means of a sealing element 4, whereas the open end 1.3*e* of the third manifold pipe module 1.3 has, as in the exemplary embodiment of FIGS. 1*a* and 1*b*, the contact flange 1.5 for connecting to a downstream exhaust system.

Figure 3:
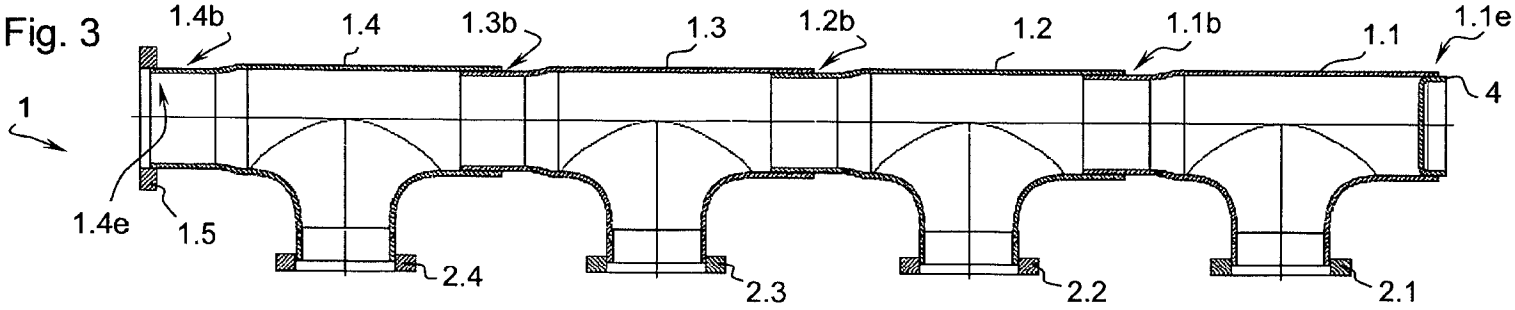
FIG. 3 shows a sectional view according to the embodiment of FIG. 2 with four modules.

According to the exemplary embodiment of FIG. 3, the modular exhaust manifold 1 has, in contrast to the exemplary embodiment of FIG. 2, a total of four manifold pipe modules 1.1 to 1.4. The manifold pipe modules 1.1 to 1.4 are telescoped, corresponding to the exemplary embodiment of FIG. 2, by means of the corresponding overlapping contour 1.1*b* to 1.3*b*, wherein the open end 1.1*e* of the manifold pipe module 1.1 is correspondingly provided with the sealing element 4 and the fourth manifold pipe module 1.4 has the contact flange 1.5 at the open end 1.4*e*.

Figure 4:
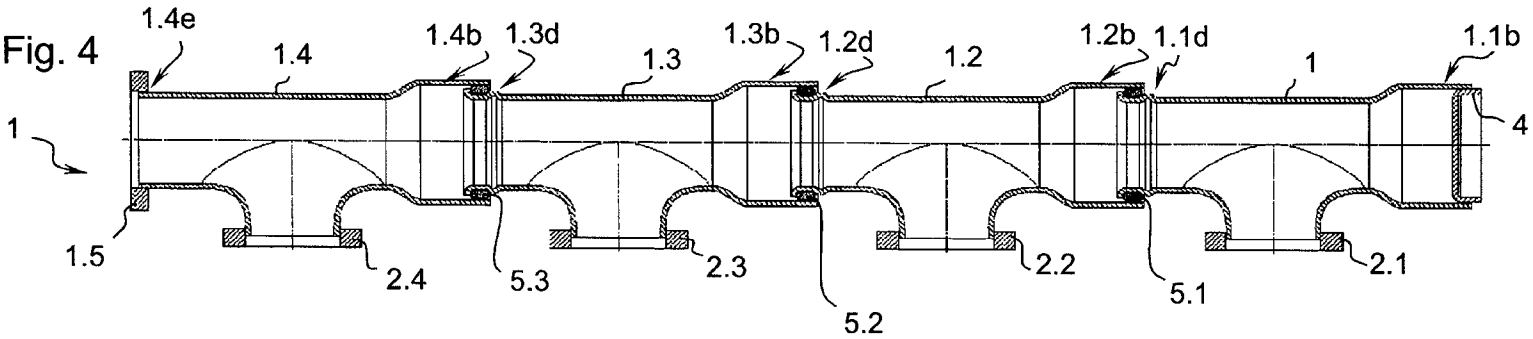
FIG. 4 shows a sectional view of an exhaust manifold with four modules and additionally shows seals.
Figure 5:
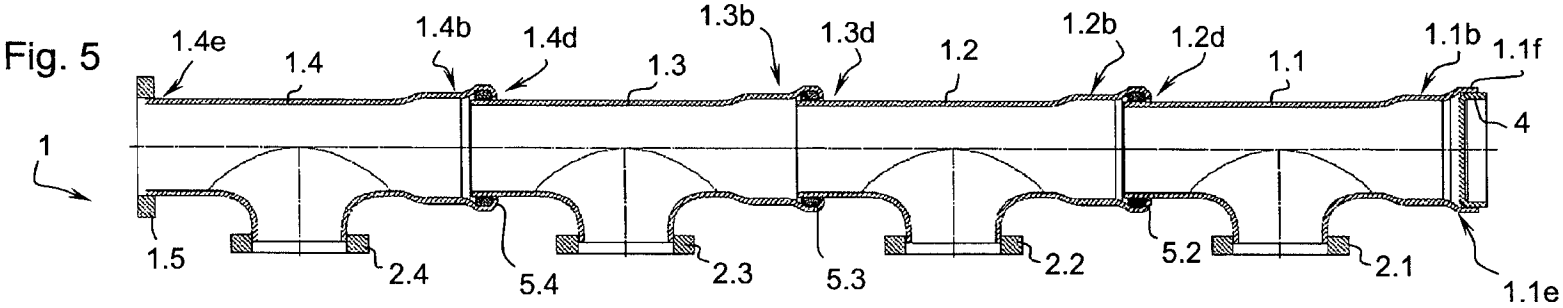
FIG. 5 shows an embodiment according to FIG. 4 with a changed arrangement of the seal.

In the exemplary embodiment according to FIG. 4, four manifold pipe modules 1.1 to 1.4 are provided as well. In contrast to the exemplary embodiments of FIGS. 1*a* to 3, the respective overlapping contour 1.1*b* to 1.4*b* is configured as a diameter expansion that enables the adjacent manifold pipe module to be slipped on. Moreover, a sealing ring 5.1 to 5.4 is provided in the region of the overlapping contour configured in this way, said sealing ring sealingly contacting the cylindrical overlapping contour 1.2*b* to 1.4*b* along the periphery. The manifold pipe module 1.1 to 1.3 that carries the seal has, at the corresponding open end, a holding geometry 1.1*d* to 1.3*d* for supporting or fixing the sealing ring 5.1 to 5.3. The holding geometry 1.1*d* to 1.4*d* is configured as a toric enlargement in comparison with the main diameter, said toric enlargement cooperating with an expanded portion on the front side so that the respective sealing ring 5.1 to 5.3 is embedded, over part of its thickness, in the ring channel formed in this way and cannot slip axially. In the region of the open end of the fourth manifold pipe module 1.4, the aforementioned holding geometry for a sealing ring to be provided is not provided because the contact flange 1.5 is attached to this open end 1.4*e*. In this respect, the shape of the fourth manifold pipe module 1.4 differs from that of the first three manifold pipe modules 1.1 to 1.3. The exemplary embodiment of FIG. 5 also provides a sealing ring 5.2 to 5.4 between the manifold pipe modules 1.1 to 1.4. In contrast to the embodiment according to FIG. 4, the embodiment of FIG. 5 provides a holding geometry 1.2*d* to 1.4*d* for the respective sealing ring 5.2 to 5.4, said holding geometry being provided in the respective overlapping contour 1.2*b* to 1.4*b*. The holding geometry 1.2*d* to 1.4*d* is configured as a ring-groove-shaped extension of the aforementioned overlapping contour 1.2*b* to 1.4*b* so that the respective sealing ring 5.2 to 5.4 fits closely along the periphery within the aforementioned ring groove, while it sealingly contacts the respective open end of the respective inserted manifold pipe module 1.1 to 1.3 after slipping on. The open end 1.1*e* of the first manifold pipe module 1.1 has the sealing element 4, wherein the open end 1.1*e* of the first manifold pipe module 1.1 has a further diameter enlargement 1.1*f* at the front-side end of the overlapping contour 1.1*b*. The sealing element 4 is arranged in said diameter enlargement 1.1*f*.

Figure 6:
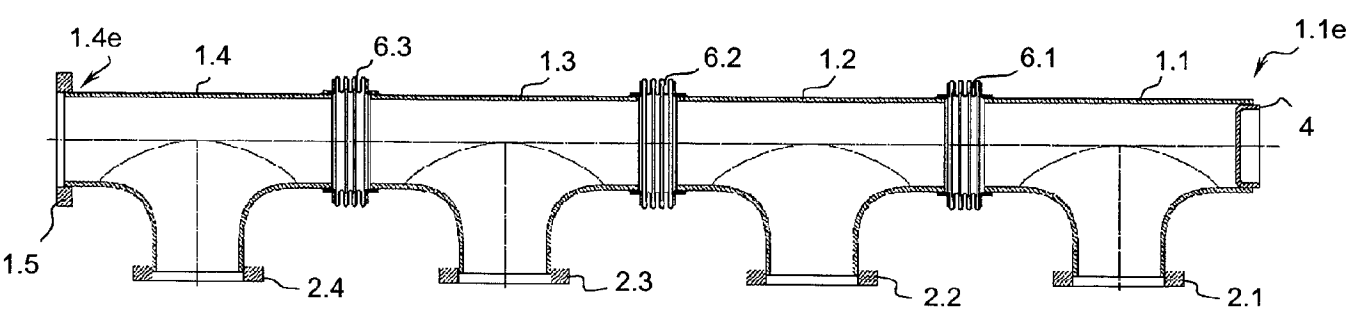
FIG. 6 shows a sectional view of a modular manifold with expansion components between the modules.

According to the exemplary embodiment of FIG. 6, one expansion component 6.1 to 6.3 at a time is provided between the four manifold pipe modules 1.1 to 1.4. By means of said expansion component, the manifold pipe modules 1.1 to 1.4 are so connected as to be gas-tight and to exhibit appropriate flexibility, wherein the respective open ends of the respective manifold pipe module 1.1 to 1.4 are cylindrical without any overlapping contour, wherein the respective expansion component is provided with a correspondingly larger diameter so that it is slipped on the respective open end. Like the sealing element 4, the expansion components and the flanges 1.5, 2.1 to 2.4 are so connected (preferably by welding or soldering) to the respective manifold pipe module as to be gas-tight.

According to the exemplary embodiment of FIG. 7*a*, the exhaust manifold 1 is configured as a two-shell air-gap-insulated exhaust manifold. For this purpose, each manifold pipe module 1.1 to 1.4 has a separate outer shell module 3.1 to 3.4, wherein both the respective manifold pipe module 1.1 to 1.4 and the respective outer shell module 3.1 to 3.4 have a separate overlapping contour 1.1*b* to 1.1*c*, 3.2*b* to 3.4*b*, by means of which adjacent manifold pipe modules as well as adjacent outer shell modules 3.1 to 3.4 are telescoped or slipped on each other. The overlapping contour 1.1*b* to 1.4*b* of the manifold pipe module 1.1 to 1.3 is configured as a taper, whereas the respective overlapping contour 3.2*b* to 3.4*b* of the outer shell module 3.2 to 3.4 is configured as a diameter expansion so that the air gap to be created will not become smaller in the region of the overlapping contours, either, i.e., not smaller than in the other regions. The sealing element 4 is inserted in the open end 1.1*e* of the manifold pipe module 1.1 and also contacts the open end 3.1*e* of the outer shell module 3.1 so that it can be so connected to the outer shell module 3.1 there as to be gas-tight. The contact flange 1.5 is slipped on the open end 3.4*e* of the manifold pipe module 1.4 as well as on the open end of the outer shell module 3.4 and can be so connected as to be gas-tight as desired. As shown in the exemplary embodiment according to FIG. 7*b*, the respective outer shell module 3.1 to 3.4 also has a joining surface 3.1*c* to 3.4*c* that is root-penetration-welded particularly in the respective region of an overlapping contour 3.1*b* to 3.4*b* or in the region of a respective inlet connecting piece 3.1*a* to 3.4*a* or open end according to FIG. 7*a* so that a gas-tight connection to the respective engine flange 2.1 to 2.4 or to the contact flange 1.5 or to the sealing element 4 is ensured.

LIST OF REFERENCE NUMERALS

1 exhaust manifold
1.1 manifold pipe module
1.1*a* inlet connecting piece
1.1*b* overlapping contour
1.1*c* joining surface
1.1*d* holding geometry
1.1*e* free, open end
1.1*f* diameter enlargement
1.2 manifold pipe module
1.2*a* inlet connecting piece
1.2*b* overlapping contour
1.2*c* joining surface
1.2*d* holding geometry
1.3 manifold pipe module, collector pipe module
1.3*a* inlet connecting piece
1.3*b* overlapping contour
1.3*c* joining surface
1.3*d* holding geometry
1.3*e* free, open end
1.4 manifold pipe module, collector pipe module
1.4*a* inlet connecting piece
1.4*b* overlapping contour
1.4*c* joining surface
1.4*d* holding geometry
1.4*e* free, open end
1.5 contact flange
2.1 engine flange
2.2 engine flange
2.3 engine flange
2.4 engine flange
3.1 outer shell module
3.1*a* inlet connecting piece
3.1*b* overlapping contour
3.1*c* joining surface

3.1*e* free, open end
3.2 outer shell module
3.2*a* inlet connecting piece
3.2*b* overlapping contour
3.2*c* joining surface
3.3 outer shell module
3.3*a* inlet connecting piece
3.3*b* overlapping contour
3.3*c* joining surface
3.4 outer shell module
3.4*a* inlet connecting piece
3.4*b* overlapping contour
3.4*c* joining surface
3.4*e* free, open end
4 sealing element
5.1 seal, sealing ring
5.2 seal, sealing ring
5.3 seal, sealing ring
5.4 seal, sealing ring
6.1 expansion component
6.2 expansion component
6.3 expansion component
a length
t insertion depth

What is claimed is:

1. A modular exhaust manifold of a motor vehicle comprising: multiple adjoining single-wall manifold pipe modules, with at least one engine flange, via which multiple inlet connecting pieces of the manifold pipe modules can be connected to a cylinder head of the motor vehicle, wherein at least one manifold pipe module configured as a collector pipe module and having a contact flange is provided, via which manifold pipe module the exhaust manifold can be connected to an exhaust system of the motor vehicle, wherein each of the manifold pipe modules has a cylindrical overlapping contour of a length (a) that ensures a telescoping of two adjacent manifold pipe modules at a time to an insertion depth (t) for a purpose of coupling and welding afterwards, wherein at least two manifold pipe modules are identical in shape, wherein at least one of two adjacent manifold pipe modules of the identical shape has a diameter of the cylindrical overlapping contour that is a) tapered with respect to a non-overlapping contour portion of the other adjacent manifold pipe module of identical shape or b) expanded with respect to the non-overlapping contour portion of the other adjacent manifold pipe module of identical shape, wherein each of the manifold pipe modules are made of sheet metal and have only one inlet connecting piece at a time, wherein formation of the length (a) of the overlapping contour allows for a variation of the insertion depth (t) of at least 5 mm to 100 mm for adapting to different cylinder head architectures, wherein the insertion depth (t) is fixed by welding one of the manifold pipe modules to the manifold pipe module inserted therein.

2. The exhaust manifold according to claim 1, wherein all manifold pipe modules are identical in shape with the exception of the collector pipe module or a first manifold pipe module of the manifold pipe modules, or all manifold pipe modules are identical in shape.

3. The exhaust manifold according to claim 1, wherein at least one of the manifold pipe modules is configured as a hinged shell with two joining surfaces that can be placed against each other, wherein the joining surfaces are root-penetration-welded in the region of at least one of the inlet connecting pieces.

4. The exhaust manifold according to claim 1, wherein the at least one manifold pipe module is configured as a hydroformed part or a two-shell manifold pipe module.

5. The exhaust manifold according to claim 1, wherein the manifold pipe modules have seals in a region of the overlapping contour.

6. A method, comprising the steps of: using at least three identically shaped single-shell or two-shell manifold pipe modules according to claim 1 for a complete production of modular exhaust manifolds for various cylinder head architectures.

7. The exhaust manifold according to claim 1, wherein a seal is provided, by which a first manifold pipe module of the manifold pipe modules is sealed gas-tight at a free end.

8. A modular exhaust manifold of a motor vehicle, comprising: multiple adjoining manifold pipe modules, with at least one engine flange, via which multiple inlet connecting pieces of the manifold pipe modules can be connected to a cylinder head of the motor vehicle, wherein at least one manifold pipe module configured as a collector pipe module and having a contact flange is provided, via which manifold pipe module the exhaust manifold can be connected to an exhaust system of the motor vehicle, wherein each of the manifold pipe modules has a cylindrical overlapping contour of a length (a) that ensures a telescoping of two adjacent manifold pipe modules at a time to an insertion depth (t) for a purpose of coupling and welding afterwards, wherein at least two manifold pipe modules are identical in shape, wherein at least one of two adjacent manifold pipe modules of the identical shape has a diameter of the cylindrical overlapping contour that is a) tapered with respect to a non-overlapping contour portion of the other adjacent manifold pipe module of identical shape or b) expanded with respect to the non-overlapping contour portion of the other adjacent manifold pipe module of identical shape, wherein each of the manifold pipe modules are made of sheet metal, wherein each manifold pipe module a) is provided with an outer shell module and b) is a double-walled air-gap-insulated module, wherein there is only one inlet connecting piece per manifold pipe module, wherein formation of the length (a) of the overlapping contour makes a variation of an insertion depth (t) of at least 5 mm to 100 mm possible for adapting to different cylinder head architectures, wherein the insertion depth (t) is fixed by welding one of the outer shell modules to the outer shell module inserted therein.

9. The exhaust manifold according to claim 8, wherein at least one of the outer shell modules is configured as a hinged shell, wherein in the region of the inlet connecting piece, the at least one outer shell module is so connected to the engine flange as to be gas-tight and one of the manifold pipe modules is so connected to one or more of the at least one outer shell module and to the engine flange as to be gas-tight.

10. The exhaust manifold according to claim 8, wherein the at least one manifold pipe module has an overlapping contour in a form of a taper and at least one outer shell module of a different one of the manifold pipe modules to be connected has an overlapping contour in the form of an expanded portion in this region.

11. The exhaust manifold according to claim 8, wherein a seal is provided, by which one of the outer shell modules is sealed gas-tight at the free end.

12. The exhaust manifold according to claim 8, wherein the manifold pipe modules have seals in a region of the overlapping contour.

13. The exhaust manifold according to claim 8, wherein the at least one manifold pipe module is configured as a hydroformed part or a two-shell manifold pipe module.

14. A method for producing a single-shell manifold formed from multiple adjoining manifold pipe modules, each of them having at least one joining surface and only one inlet connecting piece, comprising the steps of:

a) closing and connecting at least one of the manifold pipe modules configured as a hinged shell or made up of two shells as to be gas-tight in the region of the at least one joining surface, b) welding an engine flange onto the inlet connecting piece of one of the manifold pipe modules, c) telescoping several such manifold pipe modules, by a cylindrical overlapping contour, in a number of exhaust channels of a cylinder head to be connected, d) adjusting an insertion depth (t), when telescoping, to a respective architecture of the cylinder head and to distances between the exhaust channels of the cylinder head to be connected that result from said architecture, e) directly connecting at least three manifold pipe modules via said cylindrical overlapping contour by gas-tight welding.

15. The method according to claim 14, wherein the inlet connecting piece of at least one manifold pipe modules is shortened prior to being connected to the engine flange, said shortening being performed according to installation space conditions present.

16. The method according to claim 14, wherein the inlet connecting piece of at least one manifold pipe module is shortened prior to being connected to the engine flange, said shortening being performed according to installation space conditions present, and wherein a first manifold pipe module of the manifold pipe modules is sealed gas-tight, by a seal at a free end.

17. A method for producing a two-shell air-gap-insulated manifold formed from multiple adjoining manifold pipe modules, each of them having at least one joining surface and only one inlet connecting piece, comprising the steps of:

a) closing and connecting at least one of the manifold pipe modules made up of two shells or configured as a hinged shell as to be gas-tight in the region of the at least one joining surface, b) putting the closed manifold pipe module into an outer shell module configured as a hinged shell, c) closing the outer shell module in the region of the at least one joining surface as to be gas-tight, d) welding an engine flange onto the inlet connecting piece, e) telescoping several such manifold pipe modules by a respective cylindrical overlapping contour, in a number of exhaust channels of a cylinder head to be connected, f) adjusting an insertion depth (t), when telescoping, to a respective architecture of the cylinder head and to distances between the exhaust channels of the cylinder head to be connected that result from said architecture, g) directly connecting at least three manifold pipe modules to each other via said cylindrical overlapping contour by welding the outer shell modules thereof.

18. The method according to claim 17, wherein one or more of a first manifold pipe module of the manifold pipe modules and the outer shell module are/is sealed gas-tight, by a seal, in the region of the overlapping contour that is still free or of a free end.

19. The method according to claim 17, wherein the inlet connecting piece of at least one manifold pipe module is shortened prior to being connected to the engine flange, said shortening being performed according to installation space conditions present, and wherein one or more of the outer shell module is sealed gas-tight, by a seal, in the region of the overlapping contour that is still free.

* * * * *